United States Patent [19]

Osbourne

[11] 4,276,667

[45] Jul. 7, 1981

[54] DEVICE FOR HOLDING BED CLOTHES IN POSITION

[76] Inventor: Barry C. Osbourne, 3 Cameron St., Herne Bay, Auckland, New Zealand

[21] Appl. No.: 3,097

[22] Filed: Jan. 12, 1979

[51] Int. Cl.[3] ..... A47C 21/02

[52] U.S. Cl. ..... 5/498; 24/72.5

[58] Field of Search ..... 5/460, 495, 488, 498, 5/425, 426, 427, 428, 429, 430, 494, 499, 504; 24/72.5; D6/292

[56] References Cited

U.S. PATENT DOCUMENTS

| | | | |
|---|---|---|---|
| 267,498 | 11/1902 | Cox | 5/498 |
| 728,204 | 5/1903 | Coffman | 24/72.5 |
| 1,012,629 | 12/1911 | Greusel | 5/498 |
| 2,284,778 | 6/1942 | Treiber | 5/498 |
| 2,653,363 | 9/1953 | Lievsay, Jr. | 24/72.5 |
| 2,769,989 | 11/1956 | Woodford | 5/498 |
| 4,015,299 | 4/1977 | Tinnel | 5/451 |

FOREIGN PATENT DOCUMENTS

| | | | |
|---|---|---|---|
| 23322 | 10/1907 | New Zealand | 24/72.5 |
| 24307 | 5/1908 | New Zealand | 24/72.5 |

*Primary Examiner*—Alexander Grosz

*Attorney, Agent, or Firm*—Stevens, Davis, Miller & Mosher

[57] ABSTRACT

A device for holding bed clothes in position comprises a flat base and a head portion extending almost upright from the base. The head portion includes a gripping device such as a rubber block for gripping bed clothes, while the base is adapted to grip a mattress or bed base, e.g. by means of a lot of tiny hooks.

4 Claims, 2 Drawing Figures

DEVICE FOR HOLDING BED CLOTHES IN POSITION

BACKGROUND OF THE INVENTION

This invention relates to a device for holding bed clothes in position. It is sometimes a problem with bed clothes, and in particular the bottom sheet and perhaps the underblanket placed over a mattress, that these frequently become untucked at the ends and sides of the bed and with movement of a person sleeping in the bed tend to bunch up on the mattress which made the bed uncomfortable for sleeping. It was with this problem in mind that the present invention was devised.

Other devices have been suggested in the past for holding bed clothes in position on a bed. Such devices are disclosed for example in New Zealand Pat. Nos. 23322 (Oct. 3, 1907) and 24307 (May 28, 1908). The latter in particular discloses a spring for retaining the bed clothes in position, but stipulates that one end of the spring be secured to the bed post.

SUMMARY OF THE INVENTION

The present invention consists in a device for holding bed clothes in position, said device comprising a substantially planar base and a head portion which projects in a substantially upright manner from the base, at or near one end of the base, the base having engagement means for engagement with a mattress or base of a bed, and the head portion having gripping means for gripping bed clothes against a side of the mattress; the construction and arrangement being such that in use the device is positioned on a bed with the base passing under the mattress and engaging with the mattress or the bed base and the head portion passing up a side of the mattress to grip the bedclothes between the head portion and the side of the mattress.

BRIEF DESCRIPTION OF THE DRAWINGS

The above gives a broad description of the present invention a preferred form of which will now be described with reference to the accompanying drawings in which.

DESCRIPTION OF THE PREFERRED EMBODIMENT

Figure 1:
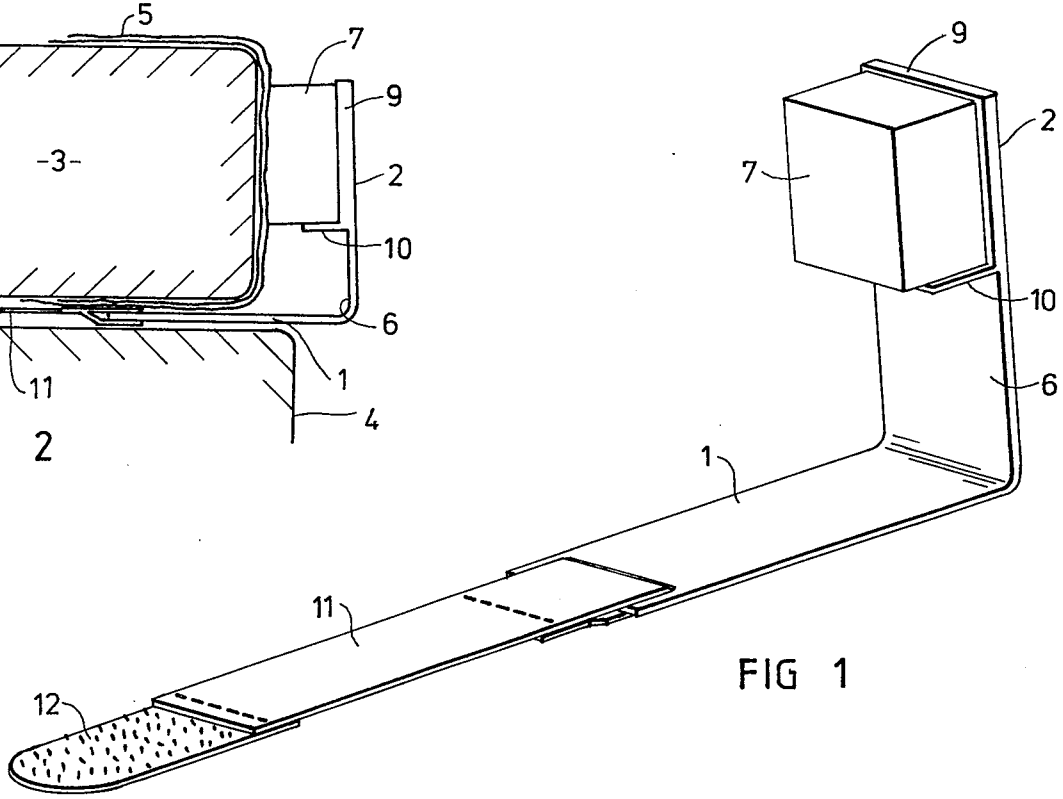
FIG. 1 shows a perspective view of the preferred device for holding bedclothes in position.
Figure 2:
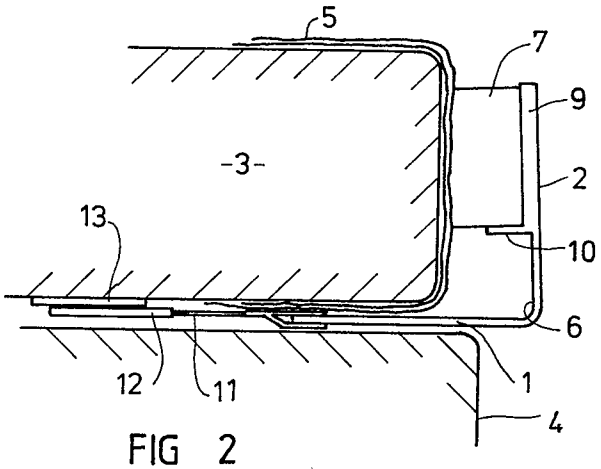
FIG. 2 shows a cross-sectional view through a mattress and base of a bed showing the device in use.

In a preferred form of the present invention a device for holding bed clothes in position has a substantially planar base 1 and a head portion 2 which projects in a substantially upright manner from the base at or near one end of the base. The base has engagement means for engagement with a mattress 3 or base 4 of a bed and the head portion has gripping means for gripping bedclothes 5 against a side of the mattress. The construction and arrangement of the device are such that in use the device is positioned on a bed base 4, which may be any form of bed base, with the base 1 of the device passing under the mattress 3 of the bed and engaging in a suitable manner with the mattress or the bed base. The head portion 2 of the device passes up a side of the mattress to grip or press the bedclothes, which pass down a side of the mattress and which are tucked under the mattress, against the side of the mattress as is best illustrated in FIG. 2. Normally four of these devices would be used, one adjacent each corner of the bed, though a smaller or greater number may be used depending on the size of the bed and bedclothes and the tendency for the bed clothes to become untucked at the sides and ends of the bed and to bunch on the mattress.

The preferred head portion is also substantially planar-having a face, this being the inner face 6, on which the gripping means are located. Thus in side elevation the device has the shape of a substantially rightangled member, though it is preferred that the head portion, be angled slightly over the base so that the top of the head portion will press more firmly against the side of the mattress and the head portion may usually have an angle of between 75° and 90° with respect to the base of the device. The head portion and base are preferably integral with each other, being moulded from a plastics material though the device could be made from other materials such as metal. The length of the head portion will depend on the thickness of the mattress but could be approximately 8 cm while the base could have a length of about 10 to 15 cm. The device can have any suitable width and other dimensions can of course be used instead.

The preferred gripping means is provided by a block of soft rubber, foam rubber or other elastomeric material 7 which is attached to the inside face 6 of the head portion of the device. Where the device is moulded from a plastics material the head portion may have raised sides 9 forming a recess in which the rubber block is seated, perhaps being retained in the recess by means of a suitable adhesive. A rubber block is particularly suitable for use as the gripping means as this will not damage the mattress or bed clothes and furthermore when the device is positioned so that the rubber block is compressed somewhat this will exert a continuous pressure clamping the bed clothes against the side of the mattress and thus reducing the possibility of these becoming untucked from the sides and ends of the bed. An additional gripping means may be provided by means of a flange 10 which projects from the head portion immediately below the rubber block, the projection of the flange being less than the thickness of the rubber block itself. In use, if the rubber block is compressed sufficiently, the outer edge of this flange 10 will also press against the mattress and bed clothes. This outer edge of the flange can be corrugated or have small projections to improve its gripping qualities in use.

The head portion of the device can be provided with other forms of gripping means. For example, these may take the form of horizontal ribs or corrugations which are attached to or which are integrally formed in the head portion of the device. Alternatively the gripping means could comprise a plurality of projections such as short blunt spikes attached to or formed on the inner surface of the head portion of the device.

As has been mentioned, the base of the device has engaging means for the engagement of the base of the device which either the base or mattress of a bed in use. In the preferred form of the invention the base of the device also has tensioning means, preferable in the form of an elastic strap 11, which is adapted to pull the head portion of the device firmly in against the bed clothes at the side of the mattress in use. The elastic strap is attached at one end to the end of the base opposite that from which the head portion projects and is attached at the outer end to the engaging means. The preferred engaging means is provided by a strip 12 of material having a large number of small hooks extending from its surface. This type of material has well known gripping qualities and tends to grip against the under side of the mattress or against the bed base depending on which way the strip faces so that in use the elastic strap 11 can be maintained in tension. However, to improve the engagement of the base of the device with the bed, it is preferred that another strip 13 of hooking material be attached directly to the underside of the mattress or to the bed base so that engagement is provided by contact between the two hooking strips 12 and 13. Of course, these can be separated if desired to remove the device from the bed.

The above describes the preferred form of the invention, which is of relatively simple construction, but of course, various modifications and alterations can be made without departing from the scope of the invention. For example, if the tensioning means is not included the gripping means is provided directly attached to or formed on the base of the device itself. If hooking material is used this may be attached as a flap to the base or adhered to the base, or alternatively the base can be provided with corrugations or projections or an adhesive surface adapted to grip one or both of the mattress or the bed base in use.

However, if a tensioning means is used the engagement means can be provided by a plate of any suitable shape and this plate can be provided with or have formed in it ridges or corrugations or projections or have a contact adhesive provided on one or both sides for the purpose of engaging with one or both of the mattress or the bed base. The engaging means could also be provided by means of a clip or pin attached to the elastic strap and adapted to be clipped or pinned to the bed base or mattress. Where an elastic strip is used any suitable means may be used for the attachment of the strap to the base of the device and to the engaging means and either permanent fastenings or releasable fastenings such as buckles or clips can be used for this purpose. A buckle or clip can be provided on the device, for example on the strap, to serve as an anchor for straps attached to an electrical blanket, thus enabling the electric blanket to be secured and ties could be used as the engaging means to tie the base of the device to the bed base.

In another form of the invention the head portion and the base can be formed separately and pivotally attached to each other so that these can be collapsed when not in use and for packaging. With this arrangement the head portion could be spring loaded so that the head portion is biased to press firmly against the side of the mattress in use.

If desired, a ridge (not shown) may be provided around the edge of the planar base 1. This ridge may serve to improve the appearance of the article, as well as to strengthen it, particularly around the slot for the strap 11.

What I claim is:

1. A device for holding bed clothes in position, said device comprising: a substantially planar base, a substantially planar head portion which projects in a substantially upright manner from the base, at or near one end of the base, gripping means located on the inner surface of the head portion for gripping bed clothes against a side of a mattress, said gripping means comprising a block of rubber having horizontal ribs or corrugations, said gripping means being located adjacent a flange member having a thickness less than said block of rubber and attached to said head portion, and mattress engaging means comprising a piece of flexible material having a plurality of small hooking means extending from its upper surface, said flexible material being attached to the base of the device by tensioning means comprising an elastic strap such that the hooking means is engagable with the underside of the mattress; the construction and arrangement being such that, in use, the device is positioned on a bed with the base passing under the mattress and engaging with the mattress as aforesaid and with the head portion passing up a side of the mattress to grip the bed clothes between the head portion and the side of the mattress.

2. A device as claimed in claim 1 wherein the base and head portion are integral with each other.

3. A device as claimed in claim 1 wherein the head portion is angled slightly over the base.

4. A device as claimed in claim 3 wherein the head portion lies at an angle of between 75° and 90° with respect to the base.

* * * * *